US008104192B2

(12) United States Patent
Myung et al.

(10) Patent No.: US 8,104,192 B2
(45) Date of Patent: Jan. 31, 2012

(54) LAUNDRY DRYER

(75) Inventors: Hwan-Joo Myung, Suwon-si (KR); Soon-Jo Lee, Changwon-si (KR)

(73) Assignee: LG Electronics Inc., Seoul (KR)

( * ) Notice: Subject to any disclaimer, the term of this patent is extended or adjusted under 35 U.S.C. 154(b) by 765 days.

(21) Appl. No.: 11/909,828

(22) PCT Filed: Mar. 24, 2006

(86) PCT No.: PCT/KR2006/001084

§ 371 (c)(1),
(2), (4) Date: Oct. 27, 2008

(87) PCT Pub. No.: WO2006/104327

PCT Pub. Date: Oct. 5, 2006

(65) Prior Publication Data

US 2009/0071030 A1 Mar. 19, 2009

(30) Foreign Application Priority Data

Mar. 31, 2005 (KR) ..... 10-2005-0026924
Mar. 31, 2005 (KR) ..... 10-2005-0026926

(51) Int. Cl.
*F26B 11/03* (2006.01)

(52) U.S. Cl. ..... 34/601; 34/606; 34/610; 68/18 R; 8/159

(58) Field of Classification Search ..... 34/595, 34/601, 602, 606, 610, 202, 218, 24, 2; 68/5 R, 68/18 R; 8/158, 159
See application file for complete search history.

(56) References Cited

U.S. PATENT DOCUMENTS 2,114,776 A * 4/1938 Davis ..... 68/18 R
2,220,414 A * 11/1940 Kritzer ..... 126/6
2,539,613 A * 1/1951 Guyon ..... 62/258
2,547,238 A * 4/1951 Tremblay ..... 34/603
2,608,769 A * 9/1952 O'Neil ..... 34/131
2,617,203 A * 11/1952 Murray ..... 34/82
2,623,299 A * 12/1952 Kauffman ..... 34/82

(Continued)

FOREIGN PATENT DOCUMENTS

CN 1600981 3/2005

(Continued)

OTHER PUBLICATIONS

Chinese Office Action dated May 8, 2009.

*Primary Examiner* — Stephen M. Gravini
(74) *Attorney, Agent, or Firm* — Ked & Associates LLP

(57) ABSTRACT

A laundry dryer is provided. The laundry dryer includes a drying drum (14), a drying duct (17), a heater (166), an upper base (22), a lower base (21), and a blower (23). The drying drum (14) hold laundry. The drying duct (17) guides indoor air to be suctioned into the drying drum (14). The heater (16) heats the air suctioned into the drying drum (14) The upper base includes a drum connecting duct (203) that guides air passing from the drying drum (14) in a downward direction. The lower base (21) has the upper base (22) mounted therabove, and forms an air passage (201) that exhausts the air guided downward by the drum connecting duct (203) an indoor space. The blower (23) is mounted on one side of the lower base, and suctions air inside the drying drum (14).

21 Claims, 5 Drawing Sheets

U.S. PATENT DOCUMENTS 2,704,896 A * 3/1955 Hopkins ..... 34/76
2,708,350 A * 5/1955 Guyon ..... 62/277
2,716,820 A * 9/1955 Bourner ..... 34/82
2,718,711 A * 9/1955 Clark ..... 34/75
2,798,304 A * 7/1957 Reiter ..... 34/91
2,798,306 A * 7/1957 Reiter ..... 34/609
2,798,307 A * 7/1957 Reiter ..... 34/610
2,830,384 A * 4/1958 Zehrbach ..... 34/604
2,867,430 A * 1/1959 Hullar ..... 432/107
2,871,576 A * 2/1959 Ramey ..... 34/87
2,936,527 A * 5/1960 Hutt ..... 34/549
3,000,108 A * 9/1961 Jones et al. ..... 34/607
3,009,643 A * 11/1961 Dibert ..... 237/55
3,023,514 A * 3/1962 Gibson ..... 34/589
3,027,653 A * 4/1962 Long et al. ..... 34/86
3,032,887 A * 5/1962 Whyte et al. ..... 34/524
3,039,285 A * 6/1962 Smith ..... 68/19.2
3,060,593 A * 10/1962 Flora et al. ..... 34/601
3,102,796 A * 9/1963 Erickson ..... 34/75
3,250,097 A * 5/1966 Czech ..... 68/12.09
3,270,531 A * 9/1966 Czech ..... 68/18 R
3,274,807 A * 9/1966 Czech ..... 68/12.09
3,283,548 A * 11/1966 Czech ..... 68/12.08
3,815,257 A * 6/1974 Freze ..... 34/129
3,840,998 A * 10/1974 Marcussen ..... 34/128
3,921,308 A 11/1975 Freze ..... 34/13
3,949,732 A * 4/1976 Reines ..... 126/597
3,969,070 A * 7/1976 Thompson ..... 432/105
4,036,152 A * 7/1977 Bright ..... 110/191
4,204,339 A * 5/1980 Muller ..... 34/75
4,268,247 A * 5/1981 Freze ..... 432/21
4,308,858 A * 1/1982 Skillman ..... 126/570
4,457,704 A * 7/1984 Sommers et al. ..... 432/29
4,626,201 A * 12/1986 Grantham ..... 432/105
4,689,896 A * 9/1987 Narang ..... 34/82
4,891,892 A * 1/1990 Narang ..... 34/86
5,050,259 A * 9/1991 Tsubaki et al. ..... 8/159
5,074,131 A * 12/1991 Hirose et al. ..... 68/19.2
5,106,512 A * 4/1992 Reidy ..... 210/744
5,107,606 A * 4/1992 Tsubaki et al. ..... 34/596
5,149,446 A * 9/1992 Reidy ..... 210/744
5,203,989 A * 4/1993 Reidy ..... 210/137
5,212,969 A * 5/1993 Tsubaki et al. ..... 68/19.2
5,419,469 A * 5/1995 Urso ..... 223/70
5,463,821 A * 11/1995 Gauer ..... 34/261
5,555,640 A * 9/1996 Ou ..... 34/202
5,662,522 A * 9/1997 Waltz ..... 454/359
5,755,040 A * 5/1998 Ou ..... 34/202
5,768,730 A * 6/1998 Matsumoto et al. ..... 8/159
5,935,525 A * 8/1999 Lincoln et al. ..... 422/121
6,189,346 B1 * 2/2001 Chen et al. ..... 68/5 R
6,938,356 B2 * 9/2005 Nagae et al. ..... 34/77
7,024,795 B2 * 4/2006 Tadano et al. ..... 34/76
7,036,243 B2 * 5/2006 Doh et al. ..... 34/595
7,093,377 B2 * 8/2006 Doh et al. ..... 34/596
7,093,378 B2 * 8/2006 Jeong et al. ..... 34/601
7,121,018 B2 * 10/2006 Lee ..... 34/595
7,127,832 B2 * 10/2006 Park et al. ..... 34/562
7,197,838 B2 * 4/2007 Jo ..... 34/76
7,406,780 B2 * 8/2008 Doh et al. ..... 34/606
7,409,776 B2 * 8/2008 Ono et al. ..... 34/77
7,506,458 B2 * 3/2009 Lee et al. ..... 34/601
7,562,467 B2 * 7/2009 Doh ..... 34/601
7,640,678 B2 * 1/2010 Lee et al. ..... 34/601
7,644,515 B2 * 1/2010 Doh ..... 34/603
7,694,434 B2 * 4/2010 Lee ..... 34/607
7,765,715 B2 * 8/2010 Kim ..... 34/491
7,926,201 B2 * 4/2011 Kim et al. ..... 34/524
2003/0126691 A1 * 7/2003 Gerlach et al. ..... 8/158
2004/0103556 A1 * 6/2004 Bang ..... 34/595
2005/0044744 A1 * 3/2005 Tadano et al. ..... 34/596
2005/0050764 A1 * 3/2005 Jeong et al. ..... 34/601
2005/0072017 A1 * 4/2005 Jo ..... 34/62
2005/0086827 A1 * 4/2005 Nagae et al. ..... 34/218
2005/0102852 A1 * 5/2005 Mizhari ..... 34/130
2005/0132594 A1 * 6/2005 Doh et al. ..... 34/73
2005/0132601 A1 * 6/2005 Doh ..... 34/601
2005/0138831 A1 * 6/2005 Lee ..... 34/73
2005/0166421 A1 * 8/2005 Doh et al. ..... 34/603
2005/0198852 A1 * 9/2005 Ono et al. ..... 34/77
2005/0252028 A1 * 11/2005 Park et al. ..... 34/528
2005/0262885 A1 * 12/2005 Byun et al. ..... 68/19.2
2006/0218817 A1 * 10/2006 Lee ..... 34/604
2006/0218976 A1 * 10/2006 Lee et al. ..... 68/15
2006/0230630 A1 * 10/2006 Lee et al. ..... 34/108
2006/0236560 A1 * 10/2006 Doh et al. ..... 34/596
2006/0272173 A1 * 12/2006 Myung ..... 34/469
2007/0062513 A1 * 3/2007 Gagas ..... 126/299 D
2008/0072450 A1 * 3/2008 Kim et al. ..... 34/524
2008/0078100 A1 * 4/2008 Kim et al. ..... 34/524
2008/0148592 A1 * 6/2008 Kim et al. ..... 34/89
2008/0148597 A1 * 6/2008 Kim et al. ..... 34/549
2008/0235977 A1 * 10/2008 Kuwabara ..... 34/77
2008/0235978 A1 * 10/2008 Epstein ..... 34/82
2008/0271336 A1 * 11/2008 Doh ..... 34/82
2009/0071030 A1 * 3/2009 Myung et al. ..... 34/138
2009/0158928 A1 * 6/2009 Wu et al. ..... 95/115
2009/0172969 A1 * 7/2009 Kim ..... 34/491
2009/0184141 A1 * 7/2009 Marino et al. ..... 223/69
2009/0230574 A1 * 9/2009 Jursich ..... 261/102
2010/0071224 A1 * 3/2010 Chung ..... 34/218
2010/0162586 A1 * 7/2010 Lee ..... 34/130
2010/0199512 A1 * 8/2010 Tomochika et al. ..... 34/73

FOREIGN PATENT DOCUMENTS

DE 4212697 A1 * 10/1993
DE 4212700 A1 * 10/1993
DE 4238546 A1 * 5/1994
DE 4422191 A1 * 1/1995
DE 102 02 442 8/2003
EP 106289 A2 * 4/1984
EP 356689 A1 * 3/1990
EP 623699 A1 * 11/1994
EP 1391550 A1 * 2/2004
EP 1 518 957 3/2005
EP 1860229 A1 * 11/2007
EP 1925713 A1 * 5/2008
EP 1925714 A1 * 5/2008
EP 1932962 A1 * 6/2008
EP 2210975 A1 * 7/2010
FR 2 517 040 5/1983
JP 54104074 A * 8/1979
JP 54139140 A * 10/1979
JP 2002233696 A * 8/2002
JP 2004350979 A * 12/2004
WO WO 2007043326 A1 * 4/2007

* cited by examiner

[Fig. 1]
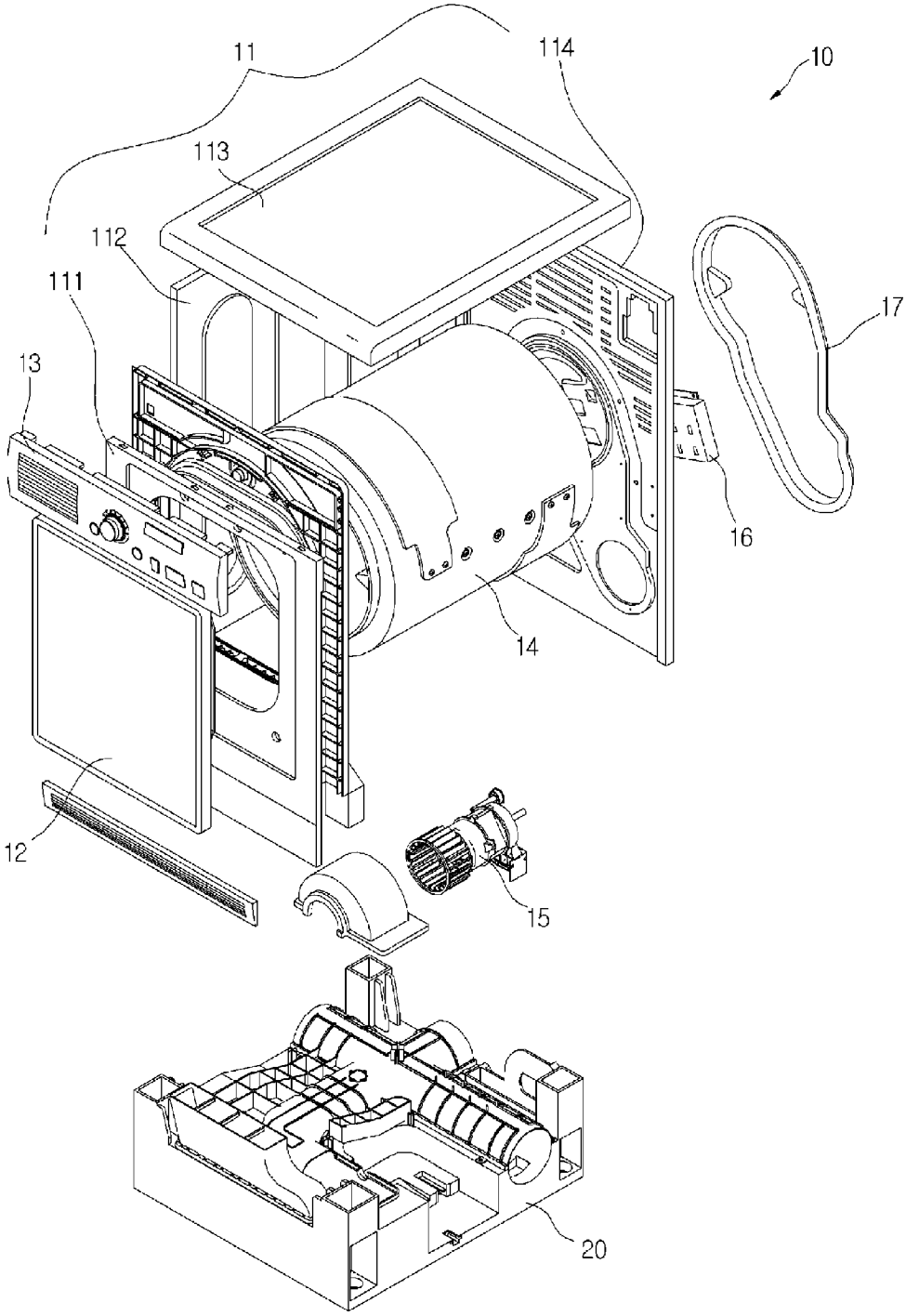

[Fig. 2]
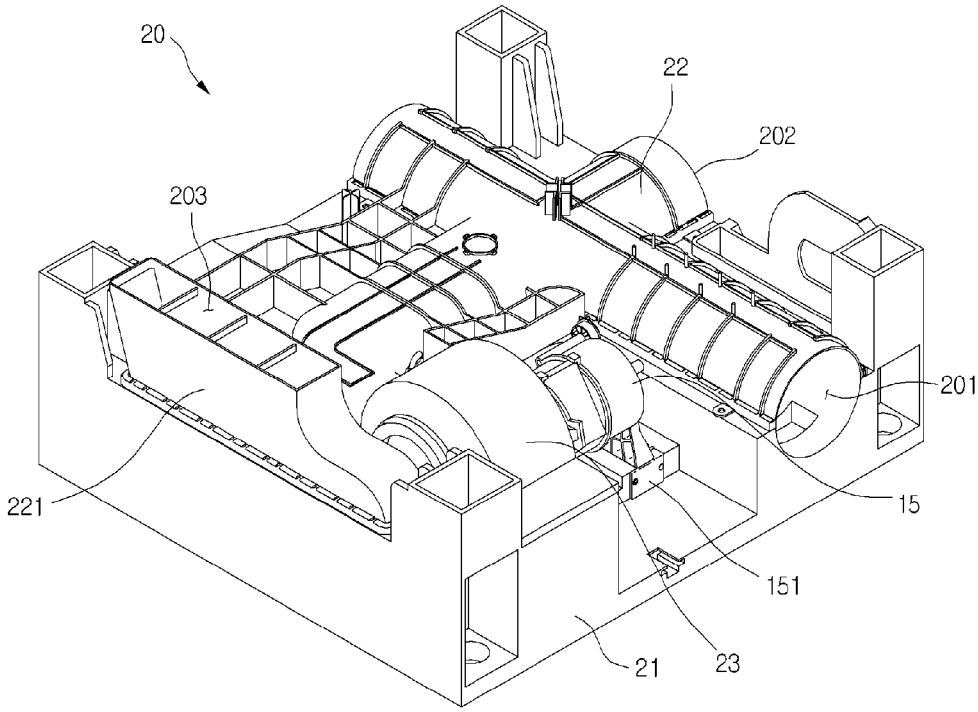
[Fig. 3]
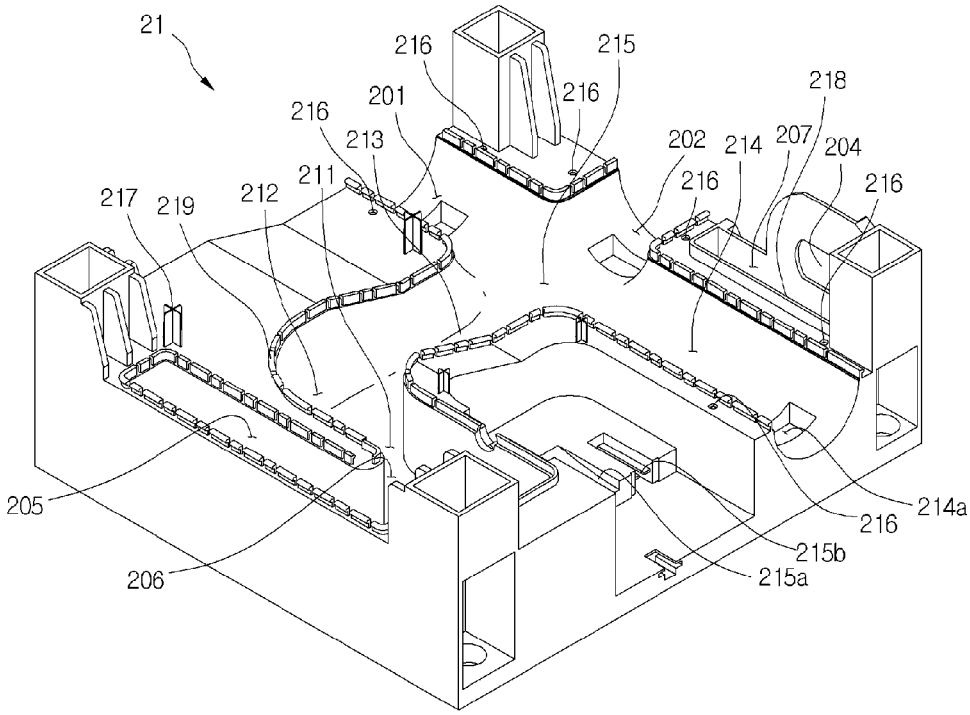

[Fig. 4]
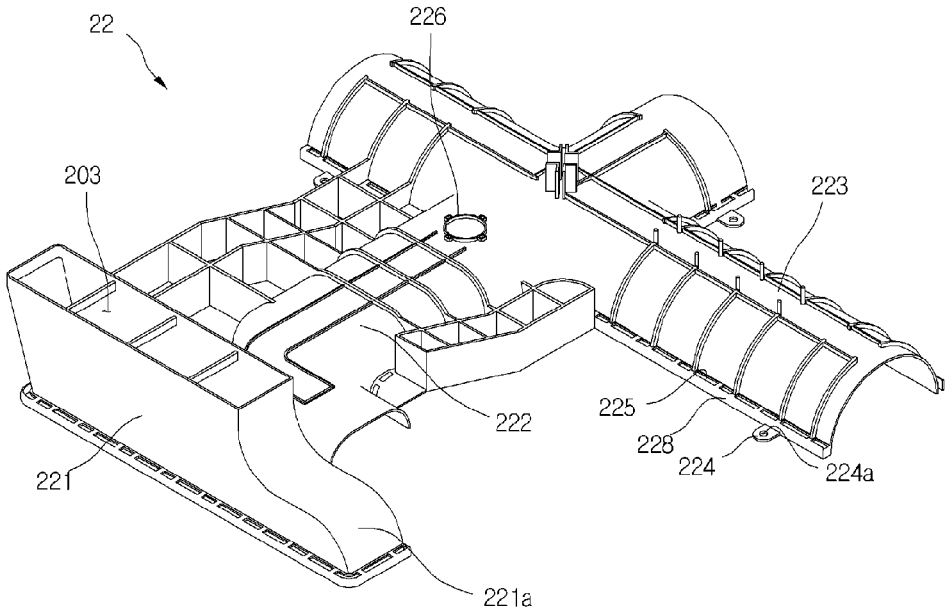
[Fig. 5]
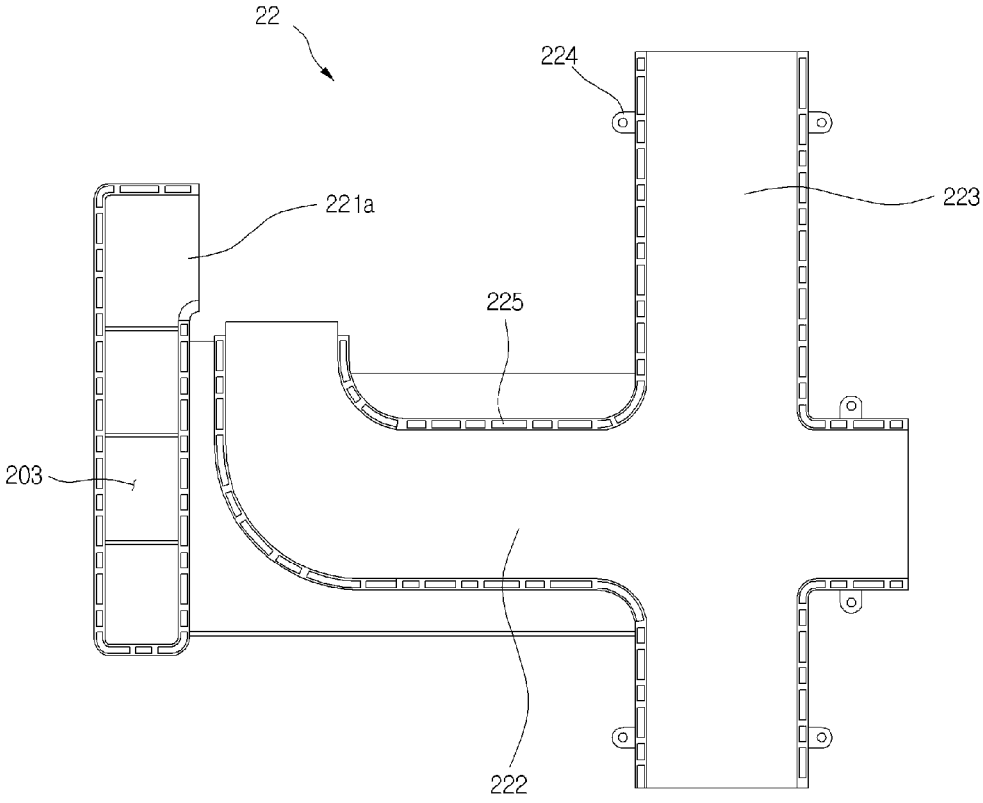

[Fig. 6]
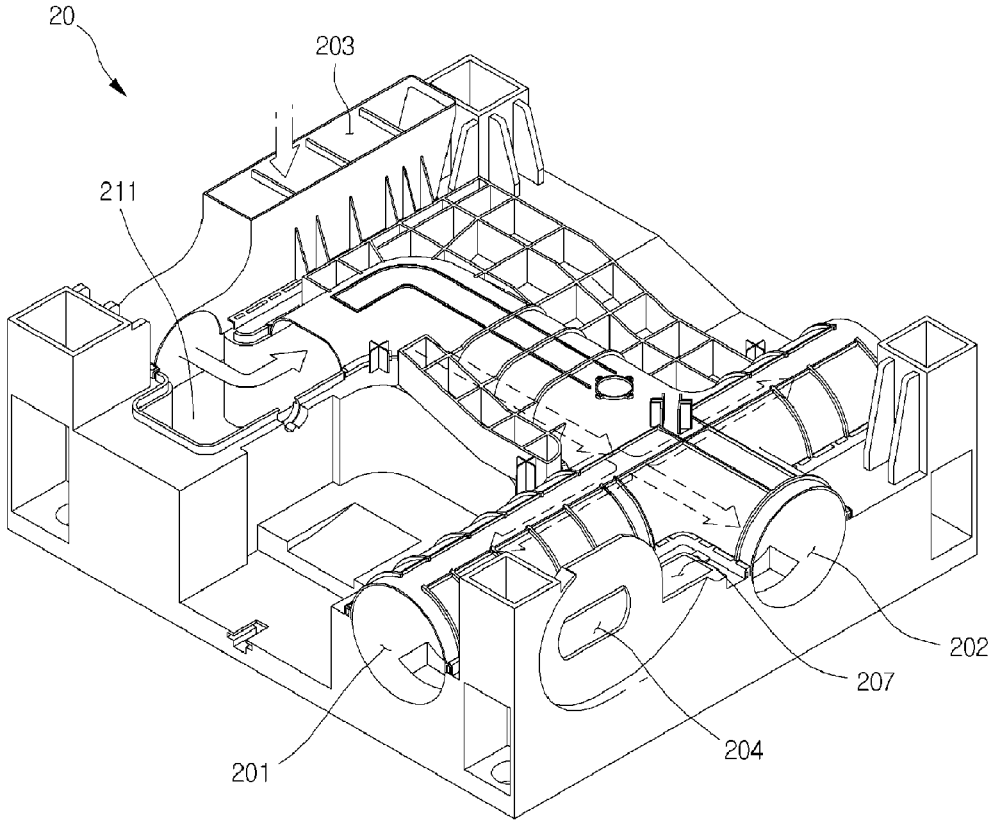
[Fig. 7]
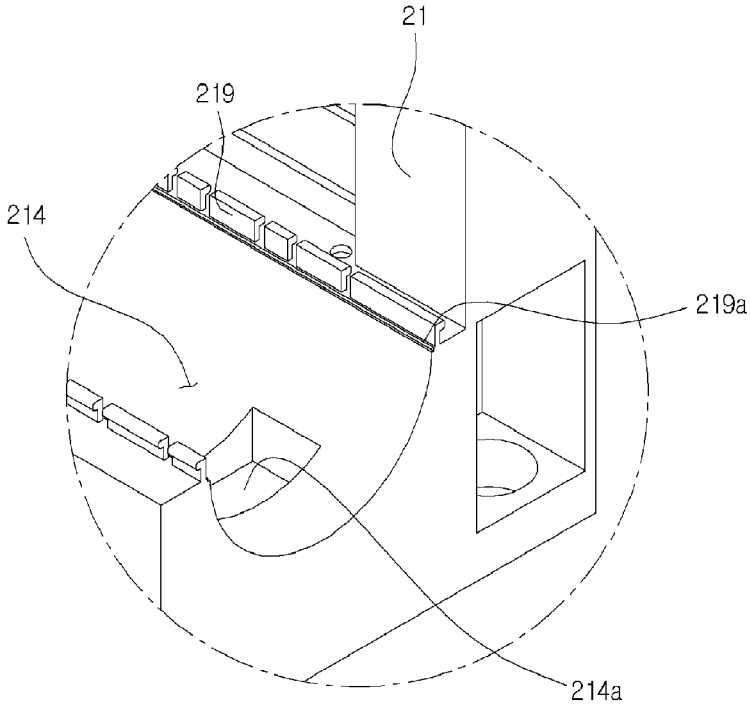

[Fig. 8]
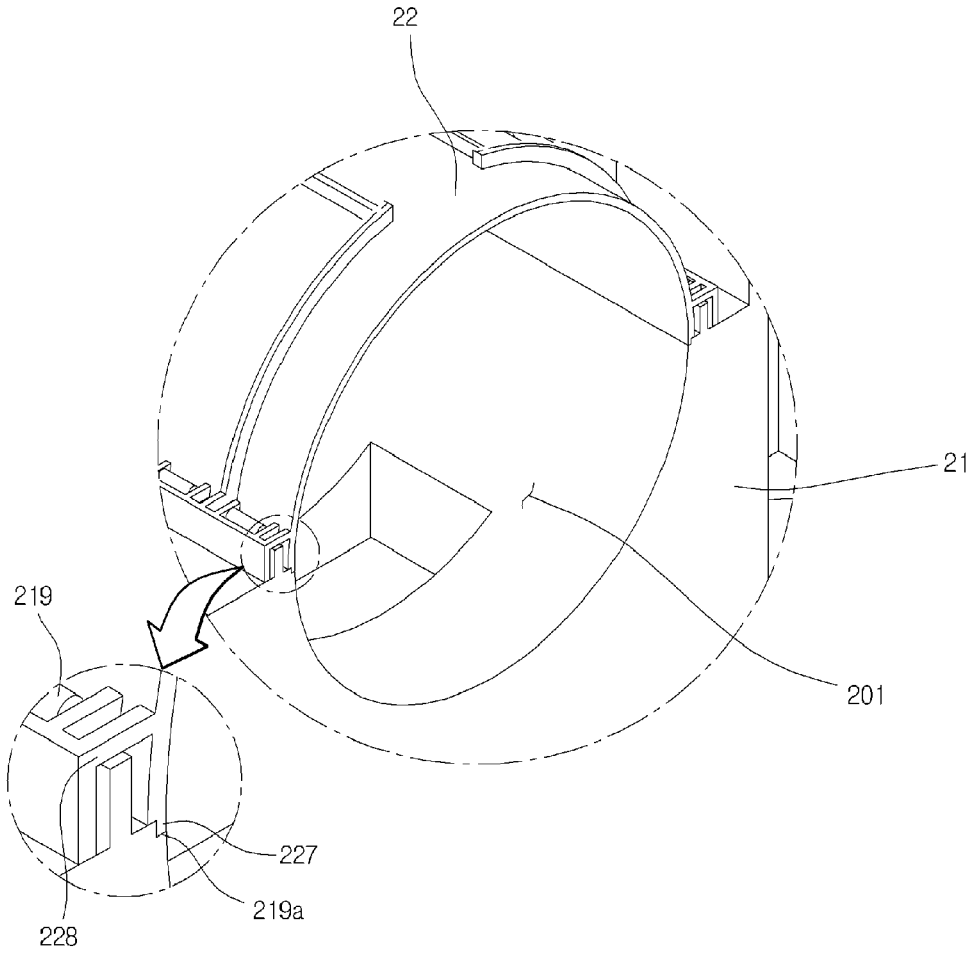
[Fig. 9]
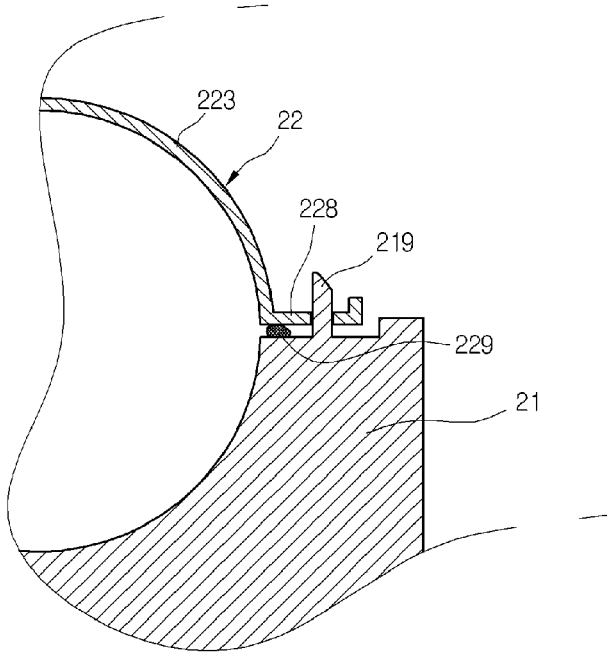

LAUNDRY DRYER

TECHNICAL FIELD

The present invention relates to a laundry dryer, and more particularly, to a laundry dryer with an altered passage structure for allowing air that has become hot and moist inside a drying drum to condense as it is exhausted to the outside through the passage, and also for allowing an unrestricted switching of an exhaust port according to the installed location of the dryer.

BACKGROUND ART

A drum dryer is a home appliance that dries laundry by circulating hot, dry air within a drying drum to dry laundry inserted therein.

Drum dryers are divided into condenser dryers that circulate air between the drying drum and a heater to dry laundry inside the drum, and vented dryers that direct air heated by a heater into the drying drum to dry laundry, after which the air is exhausted from the drying drum to the outside.

In further detail, in a vented dryer, air that has been heated while passing through a heater flows into the drum, and then leaves the drum by passing through a lint filter installed at the front of the drum, removing it of lint. The air that passes through the lint filter then flows through an exhaust assembly formed at the bottom of the dryer, to be exhausted to the outside.

However, in a vented dryer according to the related art, the exhaust assembly is usually a cylindrical tube formed in a straight line from the front to the rear of the dryer. Because the exhaust tube is short, the water vapor does not have sufficient time to condense while exiting the dryer through the exhaust passage to the outside. Thus, the water vapor is exhausted in the same state to the outside.

Also, only one exhaust port is formed at the rear of the dryer, restricting the installation location and position of the dryer.

DISCLOSURE OF INVENTION

Technical Problem

To solve the above problem, the present invention provides a laundry dryer with an improved exhaust passage that allows hot and moist air sufficient time to condense during its process of being expelled.

Another object of the present invention is to provide a laundry dryer configured to allow a user to freely select the location of an exhaust port, so that it does not limit the installed location or position of the dryer.

Technical Solution

According to an aspect of the present invention, there is provided a laundry dryer including: a drying drum for holding laundry; a drying duct for guiding indoor air to be suctioned into the drying drum; a heater for heating the air suctioned into the drying drum; an upper base including a drum connecting duct for guiding air passing from the drying drum in a downward direction; a lower base having the upper base mounted thereabove, and forming an air passage for exhausting the air guided downward by the drum connecting duct to an indoor space; and a blower mounted on one side of the lower base, for suctioning air inside the drying drum.

According to another aspect of the present invention, there is provided a laundry dryer including: a drying drum; an upper base including a drum connecting duct for guiding air passing from the drying drum in a downward direction; a lower base including an outside air intake port formed at a rear thereof, a main passage and a sub passage formed thereabove, a blower compartment for mounting a blower, and a drum air descending passage formed directly below the drum connecting duct; and a drying duct provided at an outside of the outside air intake port for guiding suctioned air into the drying drum.

According to a further aspect of the present invention, there is provided a laundry dryer including: a drying drum; a drying duct for guiding indoor air to be suctioned through a rear of the drying drum; a base including a lower base having a passage for water vapor flowing from the drying drum to flow through and a fastening hook formed along a perimeter of the passage, and an upper base for covering the passage and having an insert hole formed at a predetermined interval for inserting the fastening hook into; and a blower installed at a side of the lower base for suctioning the water vapor.

Advantageous Effects

An advantage of the laundry dryer according to the present invention is that the hot, moist air from the drying drum is afforded sufficient time to condense during its exhausting to the outside by the exhaust passage of the dryer.

Another advantage of the laundry dryer according to the present invention is that a plurality of exhaust ports for exhausting the air from the drying drum to the outside are provided, so that a user may select which exhaust port to use, based on the installed position of the dryer. Thus, installation restrictions for the dryer are reduced.

BRIEF DESCRIPTION OF THE DRAWINGS

FIG. 1 is an exploded perspective view of a laundry dryer according to the present invention.

FIG. 2 is a perspective view of a base installed in a dryer according to the present invention.

FIG. 3 is a perspective view of a lower base according to the present invention.

FIG. 4 is a perspective view of an upper base according to the present invention.

FIG. 5 is a plan view of the bottom of the upper base in FIG. 4.

FIG. 6 is a perspective view showing airflow within a base according to the present invention.

FIG. 7 is an enlarged, partial perspective view showing a fastening structure for fastening an upper base on a lower base according to the present invention.

FIG. 8 is an enlarged, partial perspective view showing a lower base coupled with an upper base according to the present invention.

FIG. 9 is a sectional view of a water vapor leakage preventing structure according to an alternate embodiment of the present invention.

BEST MODE FOR CARRYING OUT THE INVENTION

Reference will now be made in detail to the preferred embodiments of the present invention, examples of which are illustrated in the accompanying drawings. Wherever possible, the same reference numbers will be used throughout the drawings to refer to the same or like parts.

FIG. 1 is an exploded perspective view of a laundry dryer according to the present invention.

Referring to FIG. 1, a dryer 10 with a passage structure according to the present invention includes a drying drum 14 for putting laundry into, a cabinet 11 installed outside the drying drum 14 for protecting the drying drum 14, a base 20 installed below the drying drum 14 and having an air exhaust duct formed within, and a motor 15 mounted on the upper portion of the base 20 for rotating the drying drum 14.

In more detail, the cabinet 11 includes a front cover 111 for supporting the front portion of the drying drum 14, a side cover 112 installed on the side of the drying drum 14, and a back cover 114 supporting the rear of the drying drum 14.

The dryer 10 also includes a door 12 pivotally installed at the front of the front cover 111 to open and close the opening at the front of the drying drum 14 for inserting and extracting laundry, a control panel 13 installed above the door 12 and having buttons for inputting dryer settings and operation, a drying duct 17 installed at the rear of the back cover 114 to guide outside air into the drying drum, and a heater 16 installed inside the drying duct 17 to heat the outside air drawn in.

The operation of the above-described dryer 10 will now be explained.

First, a user opens the door 12 and inserts laundry into the drying drum 14. Then, using the setting portion on the control panel 13, the user inputs dryer settings. When the start button is pressed, the motor 15 and the heater 16 installed inside the drying duct 17 operate. A suctioning blower installed below the base 20 rotates to suction outside air into the dryer 10.

In more detail, outside air enters the drying duct 17 through an outside air intake port (described later) formed at the bottom of the back cover 114, and is heated while passing through the drying duct 17. The heated air enters the drying drum 14 through a rear wall of the drying drum 14. The heated air that enters the drying drum 14 absorbs moisture imbued in laundry and becomes water vapor. The air that becomes hot and moist leaves the drying drum 14 by passing through a lint filter (not shown) formed on the front cover 111, shedding impurities such as lint in the process.

The air that passes through the lint filter flows along the exhaust passage (described below) installed on the base 20, and is ultimately exhausted out from the dryer 10. Here, the base 20 forms a passage within for air to be exhausted, and exhaust ports are formed on the sides and rear of the base 20. One of the exhaust ports may be open while the remaining ports may be sealed. The air passage formed within the base 20 will be described in further detail below with reference to the diagrams.

FIG. 2 is a perspective view of a base installed in a dryer according to the present invention.

Referring to FIG. 2, the base 20 of the dryer according to the present invention includes a lower base 21 and an upper base 22 mounted on top of the lower base 21.

In detail, the motor 15 is mounted on top of the lower base 21, and the passage for exhausting air is formed within the upper part of the lower base 21. The upper base 22 covers the air passage, so that the exhausting air is not dispelled but directed to flow in a predetermined direction.

In further detail, the lower base 21 and the upper base 22 are respectively plastic injection molded and coupled together in one piece by means of fasteners. However, the manufacturing method of the base 20 is not limited thereto, and may include being formed in a single piece. A drum connecting passage 203 is formed at the front upper portion of the base 20, and a side exhaust port 201 is formed at the side and a rear exhaust port 202 is formed at the rear of the base 20. The motor 15 is mounted to one side on top of the base 20, and a blower is connected to the rotating motor shaft to suction air from inside the drum. The blower is protected by a blower cover 23. Here, the blower is installed at the front of the motor 15, as shown in FIG. 1. Moreover, a suctioning blower (installed at the rear of the base 20 and not depicted in FIG. 2) is attached to and operates by means of a separate motor.

In the above-described structure, the hot, moist air discharged from the front of the drying drum 14 enters the drum connecting passage 203 and is exhausted back to the outside through the side exhaust port 201 and/or the rear exhaust port 202. Below, a detailed description of the air passages formed within the base 20 will be given, with reference to the diagrams.

FIG. 3 is a perspective view of a lower base according to the present invention.

Referring to FIG. 3, the base 20 according to the present invention, as described above, includes a lower base 21 and an upper base 22 mounted on top of the lower base 21.

In detail, an air passage, through which air is exhausted from the drying drum 14, is formed in the lower base 21. A complete air passage is formed by covering the bottom half of the air passage with the upper base 22.

In more detail, a drum air descending passage 205, for the air passing from the drying drum 14 to descend, is formed at the front of the lower base 21. A blower entrance 206 is formed on one side of the drum air descending passage 205 for the descending air to be suctioned toward the blower. A blower compartment 211 is formed for mounting the blower at the blower entrance 206. An expanded passage portion 212 that bends at a predetermined angle and expands in diameter is connected to an end of the blower compartment 211. A main passage 213 that extends to the rear end of the lower base 21 is connected at the end of the expanded passage portion 212.

A sub passage 214 is formed to intersect with the main passage 213, forming the side exhaust ports 201 at either side of the lower base 21. A condensation pan **214*a* is respectively formed of a predetermined depth into the floors at the rear exhaust port 202 and side exhaust ports 201, to collect condensing moisture from the exhausting air. A passage intersection 215 of the main passage 213 and the sub passage 214 is biased toward the rear of the lower base 21 from its center. That is, the sub passage 214 is closer to the rear of the lower base 21** than its front.

At least one upper base guiding protrusion 217 is formed on the top surface of the lower base 21, in order to guide the mounting position of the upper base 22 over the lower base 21. A fastening hook 219 is formed to protrude a predetermined height from along the perimeters of the main and sub passages 213 and 214, in order to tightly couple the upper base 22 to the lower base 21. Also, a plurality of fastening holes 216 are formed in the upper surface of the lower base 21, so that a fastening member (for fastening the upper base 22) can insert through the fastening hole 216. Specifically, the fastening holes 216 are formed symmetrically at the edges on either sides of the sub and main passages 214 and 213.

An outside air intake port 204 is formed at the rear of the lower base 21, to allow outside air to pass through the drying duct 17 into the drying drum. A suctioning blower is installed outside of the outside air intake port 204 in order to suction outside air. Here, the outside air suctioned through the outside air intake port 204 is air within the cabinet 11 of the dryer 10. A lint entry preventing slot 207 recessed at a pre-determined depth is formed at the front of the outside air intake port 204 for trapping lint and other impurities contained in the outside air suctioned through the outside air intake port 204.

In more detail, a small amount of the water vapor that may leak through small gaps between the coupling portions of the upper base 22 and the lower base 21 may mix with the outside air suctioned through the outside air intake port 204. Also, lint particles may be contained in the air from the drying drum 14 that passes through the passages. Despite this, the impurities contained within the outside air suctioned through the outside air intake port 204 will be caught in the lint entry preventing slot 207, thereby reducing the amount of impurities that enters the drying duct 17.

A lint entry preventing ledge 218 is formed to protrude a predetermined height from around the perimeter of the lint entry preventing slot 207. That is, by forming the lint entry preventing ledge 218, impurities that leak through gaps between the coupling regions of the upper base 22 and the lower base 21 are blocked in a first stage. The air filtered in a first stage by the lint entry preventing ledge 218 is filtered once more in the lint entry preventing slot 207.

A motor mount 215*a* for mounting the motor 15 is formed in the space between the blower compartment 211 and the sub passage 214, where a motor supporting insert slot 215*b* is formed for supporting a motor supporter (not shown).

In the above structure, the water vapor that descends through the drum air descending passage 205 flows through the blower entrance 206 into the blower compartment 211. The air that enters the blower compartment 211 flows through the expanded passage portion 212 to the main passage 213. The air that flows to the main passage 213 branches at the passage intersection 215 and flows through at least one of the side exhaust ports 201 and/or the rear exhaust port 202 to the outside.

Here, a portion of the two side exhaust ports 201 and the rear exhaust port 202 may be sealed with caps. For example, if the dryer 10 is installed in a corner, one of the side exhaust ports 201 and the rear exhaust port 202 may be sealed with caps, with only the remaining side exhaust port 201 opened. That is to say that caps can be used to selectively seal the exhaust ports, as mandated by the installed location of the dryer 10.

The air that flows toward the sealed exhaust ports during the circulation through the passages condenses, and the condensed water accumulates in the condensation pans 214*a*. Also, even when all the exhaust ports 201 and 202 are open, air that flows through the passages condenses, whereupon the condensed water accumulates in the condensation pans 214*a*.

FIG. 4 is a perspective view of an upper base according to the present invention, and FIG. 5 is a plan view of the bottom of the upper base in FIG. 4.

Referring to FIGS. 4 and 5, the upper base 22 according to the present invention, as described above, is mounted on top of the lower base 21.

Specifically, the upper base 22 is formed in a shape corresponding to that of the lower base 21 in terms of the passages, in order to seal the upper portion of the passages. A drum connecting passage 203 is formed at the front of the upper base 22, to provide an entrance for water vapor air exiting the drying drum 14 toward the passages.

In more detail, the drum connecting passage 203 extends a predetermined distance upward from the top of the upper base 22 to form the interior of a drum connecting duct 221. A blower connecting portion 221*a* is formed to extend from the side of the drum connecting duct 221, so that air passes through the drum connecting passage 203 and flows into the blower entrance 206 formed in the lower base 21.

A main passage cover 222 and a sub passage cover 223 are formed on the upper base 22 to cover the expanded passage portion 212, the main passage 213, and the sub passage 214 formed in the lower base 21. The main passage cover 222 and the sub passage cover 223 also intersect with each other. A humidity sensor mount 226 is formed in a portion of the main passage cover 222 for installing a humidity sensor therein, in order to detect the level of humidity of air flowing through the main passage 213.

A fringe 228 is formed to protrude a predetermined distance from the lower portions of the main passage cover 222 and the sub passage cover 223, and hook insert holes 225 in the fringe 228. Also, fastening hooks 219 are formed a predetermined distance apart from one another on the upper perimeters of the main passage 213 and the sub passage 214 of the lower base 21. The fastening hooks 219 insert into the hook insert holes 225.

The fastening tab 224 is formed to protrude further from the fringe 228 to fasten the upper base 22 to the lower base 21 more firmly. Specifically, a fastening hole 224*a* is formed in each fastening tab 224, so that a fastening member inserted through the fastening hole 224*a* inserts into the fastening hole 216 formed in the lower base 21. That is, the fastening member tightens the coupling of the upper base 22 to the lower base 21, so that no gaps are formed between the base upper and lower portions 22 and 21. In this way, the size of gaps formed between the base upper and lower portions 22 and 21 may be minimized, preventing leakage of air flowing within the passages and the possibility of it re-entering through the outside air intake port 204. In other words, the air flowing through the inside of the passages is prevented from leaking into the interior space of the cabinet 11 holding the drying drum 14 and being suctioned into the outside air intake port 204.

In the above structure, the water vapor that exits the drying drum 14 passes through the drum connecting passage 203 and descends to the drum air descending passage 205. The air that descends to the drum air descending passage 205 flows to the blower entrance 206. The air that descends to the drum connecting passage 203 flows along the blower connecting portion 221*a* and into the blower entrance 206. The air that enters the blower entrance 206 moves through the expanded passage portion 212, the main passage 213, and the sub passages 214. The air that flows through the main and sub passages 213 and 214 condenses and is exhausted to the outside through the rear exhaust port 202 and/or the side exhaust port(s) 201.

FIG. 6 is a perspective view showing airflow within a base according to the present invention.

Referring to FIG. 6, as described above, the air that passes through the drying drum 14 passes through the lint filter installed in the front cover 111 to shed impurities in a first stage, and then descends through the drum connecting passage 203. Then, the air that descends through the drum connecting passage 203 moves to the blower entrance 206 formed at the end of the blower connecting portion 221*a*.

The air that moves to the blower entrance 206 is redirected by the blower installed in the blower compartment 211. The air that is redirected by the blower flows to the expanded passage portion 212. The flow direction of the air is redirected again at the expanded passage portion 212 to the main passage 213, and the air flows to the rear of the base 20. A portion of the air flowing through the main passage 213 branches off at the passage intersection 215 (where the main and sub passages 213 and 214 intersect) to the sub passages 214. The air flowing through the main and sub passages 213 and 214 flow through the rear exhaust port 202 and/or side exhaust port(s) 201 to be exhausted back to the outside. Here, the water vapor that exits the drying drum 14 cools (and a portion of the moisture in the air condenses) during the time it takes to flow from the drum connecting passage 203 to the exhaust ports 201 and 202. The condensed moisture accumulates in the condensation pans 214*a* recessed in the floors of the main and sub passages 213 and 214.

The outside air that flows into the rear of drying drum 14, that is, outside air with the same temperature and humidity of inside air, re-enters the drying drum 14 through the drying duct 17 through the outside air intake port 204 formed at the rear of the base 20.

FIG. 7 is an enlarged, partial perspective view showing a fastening structure for fastening an upper base on a lower base according to the present invention, and FIG. 8 is an enlarged, partial perspective view showing a lower base coupled with an upper base according to the present invention.

Referring to FIGS. 7 and 8, the base 20 according to the present invention is formed with a lower base 21 coupled to an upper base 22, as described above.

In further detail, the lower base 21 is coupled to the upper base 22 by inserting the fastening hooks 219, formed a predetermined distance apart around the upper perimeters of the main passage 213 and the sub passage 214, into the hook insert holes 225 (in FIG. 4) formed in the fringe 228. By forming the fastening hooks 219, for fastening the upper base 22 to the lower base 21, the water vapor flowing through the passages 213 and 214 is prevented from leaking out from the passages. Additionally, lint and other impurities in the water vapor cannot easily leak outside from the passages.

A leak preventing step 219*a* is formed in at least one stepped structure around the perimeters of the main and sub passages 213 and 214, as shown in FIG. 7. In addition, a leak preventing step 227 corresponding to the leak preventing step 219*a* is formed around the lower portions of the main passage cover 222 and the sub passage cover 223. The leak preventing step 219*a* formed on the lower base 21 (shown in FIG. 8) and the leak preventing step 227 formed on the lower portions of the passage covers 222 and 223 of the upper base 22 are mutually interlocked. For water vapor flowing through the main and sub passages 213 and 214 to leak to the outside in the above structure, it must bypass the stepped portions, to thus reduce the amount of water vapor leakage to a minute amount. Furthermore, the impurities contained in the water vapor are not able to pass the stepped portion, to minimize the possibility of lint and other impurities in outside air entering the outside air intake port 204.

In other words, in order for the water vapor flowing through the main and sub passages 213 and 214 to leak through the gaps formed between the base upper and lower portions 22 and 21, it must first pass the stepped portion and then bypass the fastening hooks 219. Therefore, the amount of leaking water vapor is insubstantial.

FIG. 9 is a sectional view of a water vapor leakage preventing structure according to an alternate embodiment of the present invention.

Referring to FIG. 9, the base 20, according to the present invention, includes a sealing gasket 229 formed in the coupling region between the upper base 22 and the lower base 21, in order to prevent leakage of water vapor.

In further detail, instead of the stepped portion formed on the base lower and upper portions 21 and 22 illustrated in FIG. 7, a sealing gasket 229 is formed in the same region to protrude a predetermined distance upward around the perimeters of the passages.

More specifically, a sealing gasket 229 is formed to protrude a predetermined height around the upper perimeters of the main and sub passages 213 and 214 of the lower base 21. The fringe 228, that extends horizontally outward from around the perimeters of the main and sub passage covers 222 and 223 of the upper base 22, presses against the sealing gasket.

Under these circumstances, after the upper base 22 is mounted on the lower base 21, the fastening hooks 219 couple the base upper and lower portions 22 and 21. A coupling member inserts through the fastening tab 224 formed to extend from the perimeters of the main and sub passage covers 222 and 223 of the upper base 22, and the fastening hole 216 formed on the upper surface of the lower base 21. Then, the fastening member is tightened to press the base upper and lower portions 22 and 21 more tightly together. Thus, the fringe 228 presses against the sealing gasket 229 to minimize the possibility of leaking water vapor. Here, the sealing gasket 229 may be formed on the lower surface of the fringe 228 instead of on the upper surface of the lower base 21. In other words, the sealing gasket 229 may selectively be formed on either a surface of the base lower or upper portion 21 or 22.

The fastening tab 224 is formed only at the short end of the main and sub passages 213 and 214 (namely, the rear of the base 20). This is because when the rear sections of the base upper and lower portions 22 and 21 are tightly coupled by means of the fastening tab 224, the fastening hooks 219 formed on the front ends of the lower base 21 automatically insert into the hook insert holes 225 formed at the front of the upper base 22. In other words, the fastening hooks 219 automatically insert into the hook insert holes 225 formed near the drum connecting duct 221. However, the location of the fastening tab 224 is not limited to this embodiment, and may also be formed near the drum connecting duct 221.

While the present invention has been described and illustrated herein with reference to the preferred embodiments thereof, it will be apparent to those skilled in the art that various modifications and variations can be made therein without departing from the spirit and scope of the invention. Thus, it is intended that the present invention covers the modifications and variations of this invention that come within the scope of the appended claims and their equivalents.

INDUSTRIAL APPLICABILITY

The passage structure for a dryer according to the present invention not only allows hot, moist air from the drying drum to condense during the course of being expelled to the outside, but also allows the location of an exhaust port to be freely selected in order to reduce installing location restrictions, for a high industrial applicability.

The invention claimed is:

1. A laundry dryer comprising:

a drying drum to hold a laundry;

a drying duct that guides indoor air to be suctioned into the drying drum;

a heater that heats the air suctioned into the drying drum;

an upper base that includes a drum connecting duct to guide the air passing from the drying drum in a downward direction;

a lower base having the upper base mounted thereabove, and the lower base and the upper base forming an air passage that exhausts the air guided downward by the drum connecting duct to an indoor space, wherein the lower base includes at least two exhaust ports formed at a side and a rear of the lower base; and a blower mounted on one side of the lower base, the blower to suction the air inside the drying drum.

2. The laundry dryer according to claim 1, wherein the drum connecting duct communicates with the blower.

3. The laundry dryer according to claim 1, wherein the air passage includes a main passage that guides the air suctioned by the blower toward the rear of the lower base, and a sub passage that intersects the main passage.

4. The laundry dryer according to claim 3, wherein the main passage has a predetermined curvature at a predetermined location of the main passage.

5. The laundry dryer according to claim 3, wherein the main passage changes in direction at a predetermined distance from an entrance thereof, and the main passage has an exit with a larger diameter than a diameter of the entrance.

6. The laundry dryer according to claim 3, wherein the main passage and the sub passage intersect at a location that is closer to the rear of the lower base than a front of the lower base.

7. The laundry dryer according to claim 1, wherein the at least two exhaust ports are selectively opened and closed.

8. The laundry dryer according to claim 1, further comprising at least two caps that selectively open and close the at least two exhaust ports.

9. The laundry dryer according to claim 1, wherein the lower base includes an outside air intake port formed at the rear of the lower base, and wherein the outside air intake port communicates with the drying duct to allow the indoor air to enter the drying drum.

10. The laundry dryer according to claim 1, wherein the lower base includes a first leak preventing step that is stepped at least once and is formed around an upper perimeter of the air passage, and wherein the upper base further includes a second leak preventing step that is stepped at a same height as a height of the first leak preventing step and that correspond to the first leak preventing step.

11. The laundry dryer according to claim 1, further comprising:

a plurality of fastening hooks spaced a predetermined distance apart from one another around an upper surface perimeter of the air passage; and a fringe that extends from a lower region of the upper base, and that defines a plurality of insert holes corresponding to the plurality of fastening hooks through which the plurality of fastening hooks are inserted.

12. The laundry dryer according to claim 1, further comprising a sealing member interposed between a contacting region of the lower base and the upper base.

13. A laundry dryer comprising:

a drying drum;

an upper base that includes a drum connecting duct to guide air passing from the drying drum in a downward direction;

a lower base that includes an outside air intake port formed at a rear of the lower base, a main passage and a sub passage formed thereabove, a blower compartment having a blower mounted therein, and a drum air descending passage formed directly below the drum connecting duct, wherein the lower base includes at least two exhaust ports formed at a side and a rear of the lower base; and a drying duct provided at an outside of the outside air intake port to guide suctioned indoor air into the drying drum.

14. The laundry dryer according to claim 13, wherein the indoor air is suctioned through the outside air intake port and enters the drying drum through the drying duct, the air that enters the drying drum flows to the drum connecting duct, the air that flows to the drum connecting duct descends through the drum air descending passage and flows to the blower compartment, and the air that flows to the blower compartment flows through the main passage to the rear of the lower base.

15. The laundry dryer according to claim 14, wherein the air that flows through the main passage diverges and flows through the sub passage, wherein the at least two exhaust ports are formed at an end of the main passage and at an end of the sub passage, respectively, and wherein the air that flows through the main passage and the sub passage is exhausted to an indoor space through at least one of the at least two exhaust ports.

16. The laundry dryer according to claim 13, wherein water vapor that moves to the blower compartment changes direction and flows through an expanded passage portion of the main passage.

17. A laundry dryer comprising:

a drying drum;

a drying duct that guides indoor air to be suctioned through a rear of the drying drum;

a base that includes a lower base having a passage through which water vapor flowing from the drying drum flows and a plurality of fastening hooks formed along a perimeter of the passage, and an upper base that covers the passage and has a plurality of insert holes corresponding to the plurality of fastening hooks formed at a predetermined interval through which the plurality of fastening hooks are inserted, wherein the lower base includes at least two exhaust ports formed at a side and a rear of the lower base; and a blower installed at a side of the lower base to suction the water vapor.

18. The laundry dryer according to claim 17, wherein the lower base includes a blower compartment that receives the blower therein, and wherein the passage includes a main passage connected to the blower compartment and a sub passage that intersects the main passage perpendicularly at a predetermined region of the main passage.

19. The laundry dryer according to claim 17, further comprising a duct that guides the water vapor flowing from the drying drum to descend and flow toward the blower.

20. The laundry dryer according to claim 17, wherein the upper base includes a first stepped part formed on a lower surface of the upper base, and wherein the lower base includes a second stepped part corresponding to the first stepped part formed on an upper surface of the lower base.

21. The laundry dryer according to claim 1, wherein the at least two exhaust ports include a first exhaust port on the side of the lower base and a second exhaust port on the rear of the lower base.

* * * * *